US008903117B1

(12) United States Patent
Dai et al.

(10) Patent No.: US 8,903,117 B1
(45) Date of Patent: Dec. 2, 2014

(54) SPEAKER ASSEMBLY

(76) Inventors: XinWei Dai, Hong Kong (HK); Gonzalo Palenzuela, Miami, FL (US)

( * ) Notice: Subject to any disclaimer, the term of this patent is extended or adjusted under 35 U.S.C. 154(b) by 53 days.

(21) Appl. No.: 13/413,194

(22) Filed: Mar. 6, 2012

Related U.S. Application Data

(63) Continuation-in-part of application No. 12/156,669, filed on Jun. 3, 2008, now Pat. No. 8,130,997, which is a continuation-in-part of application No. 12/156,552, filed on Jun. 2, 2008, now Pat. No. 8,126,185.

(51) Int. Cl.
*H04R 9/06* (2006.01)

(52) U.S. Cl.
USPC ..... 381/386; 381/396

(58) Field of Classification Search
USPC ..... 381/386, 394, 396
See application file for complete search history.

(56) References Cited

U.S. PATENT DOCUMENTS

| | | | | | |
|---|---|---|---|---|---|
| D188,542 | S | | 8/1960 | Levy | |
| 3,684,052 | A | * | 8/1972 | Sotome | 381/398 |
| D225,069 | S | | 11/1972 | May | |
| 4,590,332 | A | * | 5/1986 | Delbuck | 381/397 |
| 4,815,558 | A | | 3/1989 | Krainhofer | |
| 5,687,247 | A | * | 11/1997 | Proni | 381/398 |
| D393,641 | S | | 4/1998 | Hai-Fu | |
| 5,949,898 | A | | 9/1999 | Proni | |
| 6,118,884 | A | | 9/2000 | Proni | |
| D432,118 | S | | 10/2000 | Honnert | |
| 6,219,431 | B1 | | 4/2001 | Proni | |
| 6,229,902 | B1 | | 5/2001 | Proni | |
| 6,243,479 | B1 | | 6/2001 | Proni | |
| D448,017 | S | | 9/2001 | Hasbrook | |
| 6,496,590 | B2 | | 12/2002 | Proni | |
| 6,501,844 | B2 | | 12/2002 | Proni | |
| D472,545 | S | | 4/2003 | Iijima et al. | |
| D472,891 | S | | 4/2003 | Proni | |
| D473,216 | S | | 4/2003 | Irby et al. | |
| D475,992 | S | | 6/2003 | Tomotaro | |
| 6,611,605 | B2 | | 8/2003 | Kim | |
| D484,116 | S | | 12/2003 | Proni | |
| D487,738 | S | | 3/2004 | Iijima et al. | |
| D488,802 | S | | 4/2004 | Uehara et al. | |
| D493,161 | S | | 7/2004 | Iijima et al. | |
| D493,445 | S | | 7/2004 | Iijima et al. | |
| D523,848 | S | | 6/2006 | Shing | |
| D535,979 | S | | 1/2007 | Shing | |
| D565,550 | S | | 4/2008 | Tai | |
| D582,893 | S | | 12/2008 | Tai | |
| 8,126,185 | B1 | | 2/2012 | Dai et al. | |
| 8,130,997 | B1 | | 3/2012 | Dai et al. | |
| 2002/0148678 | A1 | * | 10/2002 | Sahyoun | 181/172 |
| 2004/0086143 | A1 | | 5/2004 | Espiritu | |
| 2004/0228500 | A1 | | 11/2004 | Stiles | |
| 2007/0121993 | A1 | | 5/2007 | Horigome et al. | |
| 2009/0324000 | A1 | * | 12/2009 | Espiritu | 381/386 |

* cited by examiner

*Primary Examiner* — Duc Nguyen
*Assistant Examiner* — Phan Le
(74) *Attorney, Agent, or Firm* — Malloy & Malloy, P.L.

(57) ABSTRACT

A speaker assembly includes a frame and a surround that suspends a diaphragm from the frame. An outer portion of the surround is disposed, dimensioned, and configured to permit the mounting of the surround to the frame such that the surround, itself, does not need to include an outwardly extending flange and/or clamp. Rather, the outer portion of the surround is generally disposed on the frame, with the mounting surface of the outer portion of the surround extending inward relative to the outer periphery of the surround.

6 Claims, 9 Drawing Sheets

SPEAKER ASSEMBLY

CLAIM OF PRIORITY

The present application is a continuation-in-part application of previously filed, now granted application having Ser. No. 12/156,669, filed on Jun. 3, 2008, which matured into U.S. Pat. No. 8,130,997 on Mar. 6, 2012, which is a continuation-in-part application of previously filed, now granted application having Ser. No. 12/156,552, filed on Jun. 2, 2008, which matured into U.S. Pat. No. 8,126,185 on Feb. 28, 2012 are both incorporated herein in their entirety.

BACKGROUND OF THE INVENTION

1. Field of the Invention

The present specification is directed to a speaker assembly structured to permit mounting of a surround to a frame absent an outwardly extending peripheral connecting portion of the surround.

2. Description of the Related Art

A speaker is a common type of device that receives an electrical input and produces sound as an output. Speakers are used in a variety of audio equipment which can be found in homes, theatres, vehicles, and in numerous other places.

Speakers typically comprise electronic components as well as mechanical components. With particular respect to the mechanical components, one common type of speaker comprises a diaphragm, which is caused to vibrate by an electromechanical inducer. The vibration of the diaphragm in turn creates sound waves. The diaphragm is sometimes referred to as a "cone" due to its generally conical shape with the narrower end oriented towards the electromechanical inducer. Diaphragms are typically constructed of materials such as plastic, metal, celluloid, or composites.

The diaphragm and other components are basically supported by, and contained within, a frame, also known as a "basket." In particular, the diaphragm is suspended from the frame via a connection piece called a "surround." The surround is made of a soft material, such as foam, that permits limited movement of the diaphragm with minimal interference to the vibration of the diaphragm. The surround attaches to the frame via an outwardly extending peripheral connecting portion, or "flanged" portion, which generally matches with a corresponding flanged portion of the frame. More specifically, known surrounds are commonly adhered to the basket, such as by gluing. In addition, in some applications, such as those involving extreme and/or competition conditions, a gasket or clamp is used in order to create a seal so as to avoid the escape of air pressure. Also, the use of the clamp serves to reinforce the attachment of the surround the basket. When used, the clamp fits over the flanged portion of the surround and sandwiches the flanged portion of the surround between the clamp and the basket.

One drawback associated with the use of a clamp to attach the surround to the frame is that it comprises an undesired extra part, which adds costs and complexity to the speaker assembly process. It would therefore be beneficial to provide a speaker assembly structured to permit mounting of a surround to a frame without the need for a clamp.

Another disadvantage of the clamp-surround-frame combination is that the flange of the surround and, consequently, the edge of the surround must extend outwardly from the rest of the surround to provide sufficient surface area for attachment to the frame via clamping. Thus, the need for a clamp increases the overall size of the surround, which in turn reduces the potential diaphragm size for a given basket size. It would therefore be beneficial to provide for an increased cone area for a given basket size. This would make the speaker more powerful, since a larger cone area can move more air, thus increasing the sound pressure level. For instance, a fifteen inch (15") diameter subwoofer speaker would normally support a diaphragm having a thirteen inch (13") diameter at the widest part of the cone. Accordingly, it would be beneficial to increase the cone diameter from thirteen inches (13") to perhaps fourteen inches (14") or more.

It would also be beneficial to reduce or eliminate the need for the outwardly extending flanged portion of the surround, as well as provide a narrower area for mounting the surround to the frame.

SUMMARY OF THE INVENTION

The present specification is directed to a speaker assembly structured to permit mounting of a surround to a frame absent an outwardly extending flanged portion of the surround, thereby permitting incorporation of a larger diaphragm for a given basket size.

The speaker assembly comprises a surround which attaches to a diaphragm and to a frame, and which suspends the diaphragm from the frame. More specifically, an inner portion of the surround is attached to a proximal end of the diaphragm, and an outer portion of the surround is attached to the frame. The outer portion of the surround is disposed, dimensioned, and configured to provide sufficient strength to permit the mounting of the surround to the frame such that the surround does not need to include an outwardly extending peripheral connecting portion and/or a clamp. Rather, the outer portion of the surround is generally disposed on a flanged portion of the frame, with the mounting surface of the outer portion of the surround extending inward relative to the outer periphery of the surround. The inward positioning of the outer portion of the surround allows for an increase in the outer size of the surround as well as a larger cone or diaphragm for a given basket size, providing more cone surface area relative to that of a traditional speaker assembly. This provides for a more powerful speaker for a given frame diameter.

In at least one embodiment, the outer portion of the surround further comprises a lip which extends inward relative to the outer periphery of the surround, with least a portion of the mounting surface extending along the lip.

The outer portion of the surround can also include one or more support members disposed and structured to provide additional support to the surround, particularly to the outer portion itself. The support members may comprise any number of configurations. For example, in one embodiment, each of the support members comprises a fin-like configuration. In a further embodiment, each support member is disposed on the interior of the outer portion and is also connected to the lip.

The surround can be made from any suitable material that can sufficiently suspend the diaphragm during operation of the speaker assembly. For instance, in one embodiment, the surround comprises a foam rubber material of construction.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

As shown in the accompanying figures, the present specification is directed to a speaker assembly, generally indicated as 10. The speaker assembly 10 is structured to permit mounting of a surround 14 to a frame 18, absent an outwardly extending peripheral connecting portion of the surround 14, thereby permitting incorporation of a larger diaphragm 12 for a given frame 18 size.

Figure 1:
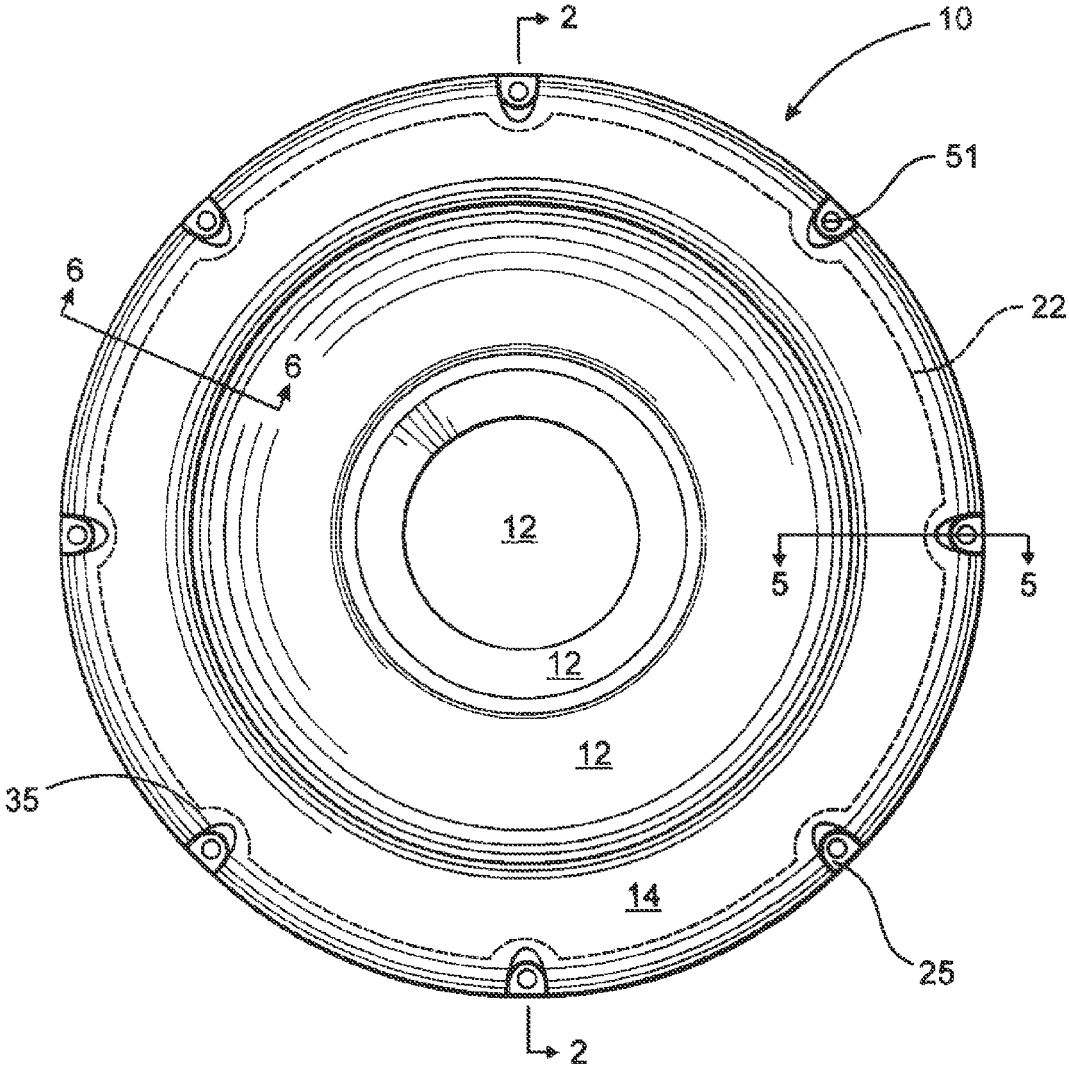
FIG. 1 is a top view of one embodiment of the present invention.
Figure 2:
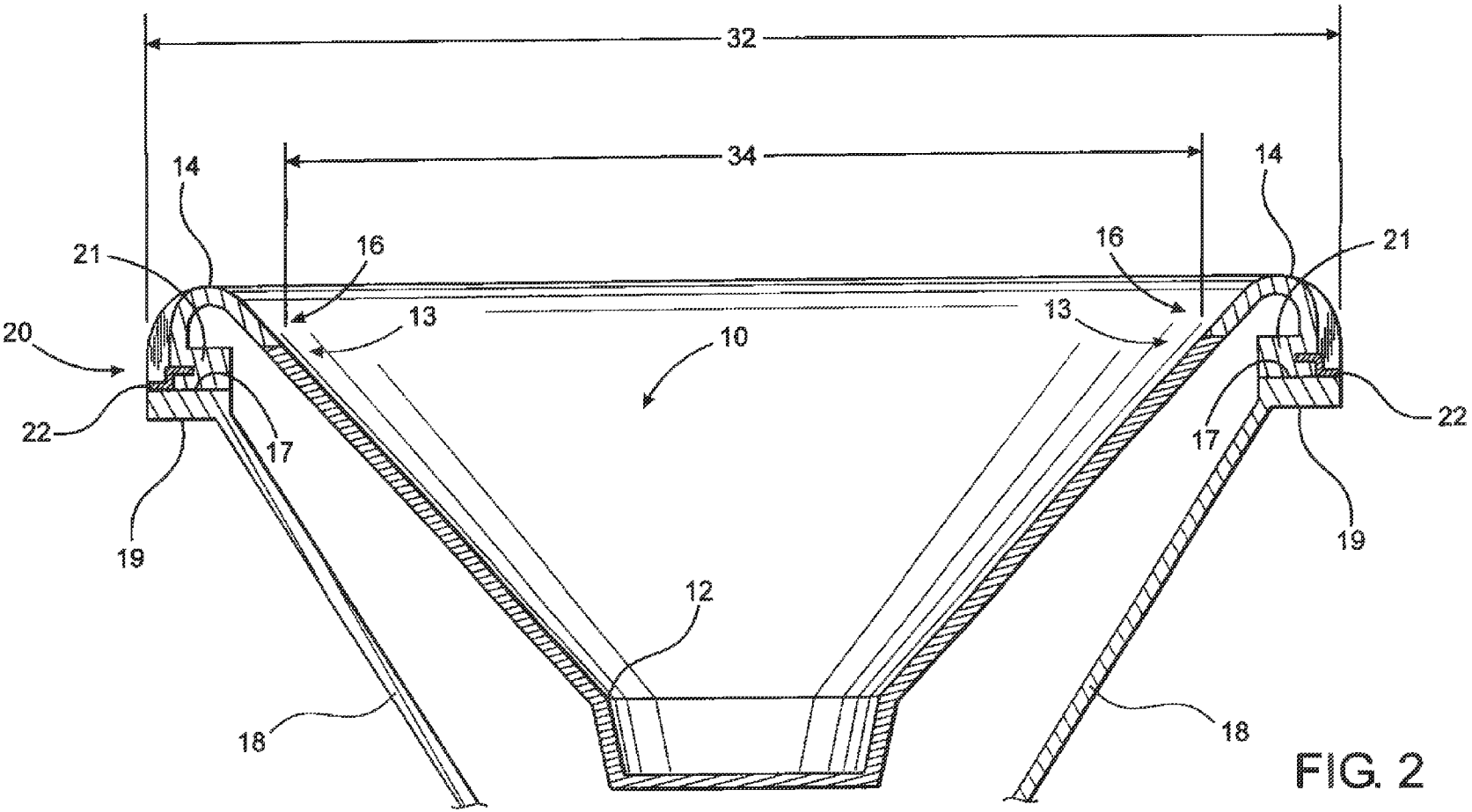
FIG. 2 is a cross-sectional view of the embodiment of FIG. 1 along line 2-2 thereof.

FIGS. 1 and 2 are illustrative of one embodiment of a speaker assembly 10 in accordance with the present application. The speaker assembly 10 generally comprises a surround 14 which attaches to a diaphragm 12 and to a frame 18 and which suspends the diaphragm 12 from the frame 18.

With reference to FIG. 2, an inner portion 16 of the surround 14 is attached to a proximal end 13 of the diaphragm 12, and an outer portion 20 of the surround 14 is attached to the frame 18. Furthermore, the frame 18 comprises a flange 19 structured to attach to and support the surround 14.

More specifically, the outer portion 20 of the surround 14 is disposed, dimensioned, and configured to provide sufficient strength to permit the mounting of the surround 14 to the frame 18 such that the surround 14, itself, does not need to include an outwardly extending flange and/or clamp. Rather, the outer portion 20 of the surround 14 is generally disposed on the flange 19, with the mounting surface 17 of the outer portion 20 of the surround 14 extending inward relative to the outer periphery of the surround 14. Accordingly, for a given frame diameter 32, the present invention permits incorporation of a larger diaphragm diameter 34 relative to that of a traditional speaker assembly. This provides for a more powerful speaker for a given frame diameter 32. For instance, the present invention permits a fifteen inch (15") diameter 32 subwoofer speaker frame to utilize a diaphragm having a diameter 34 greater than thirteen inches (13").

In at least one embodiment, the outer portion 20 of the surround 14 further comprises a lip 21 which extends inward relative to the outer periphery of the surround 14, with at least a portion of the mounting surface 17 extending along the lip 21. In a further embodiment, at least a part of the mounting surface 17 is glued, bonded, or otherwise directly adhered to the flange 19. In another embodiment, discussed in more detail below, the outer portion 20 is attached to the flange 19 utilizing at least one fastener, as at 51 in FIGS. 1 and 5.

Figure 8:
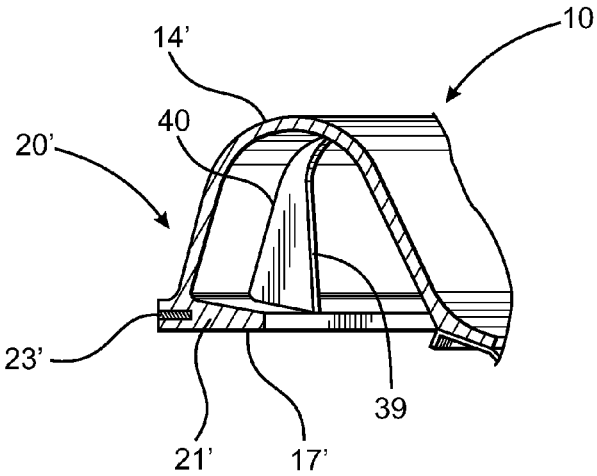
FIG. 8 is a partial cutaway view of the embodiment of FIG. 7 along a portion of line A-B thereof.
Figure 10:
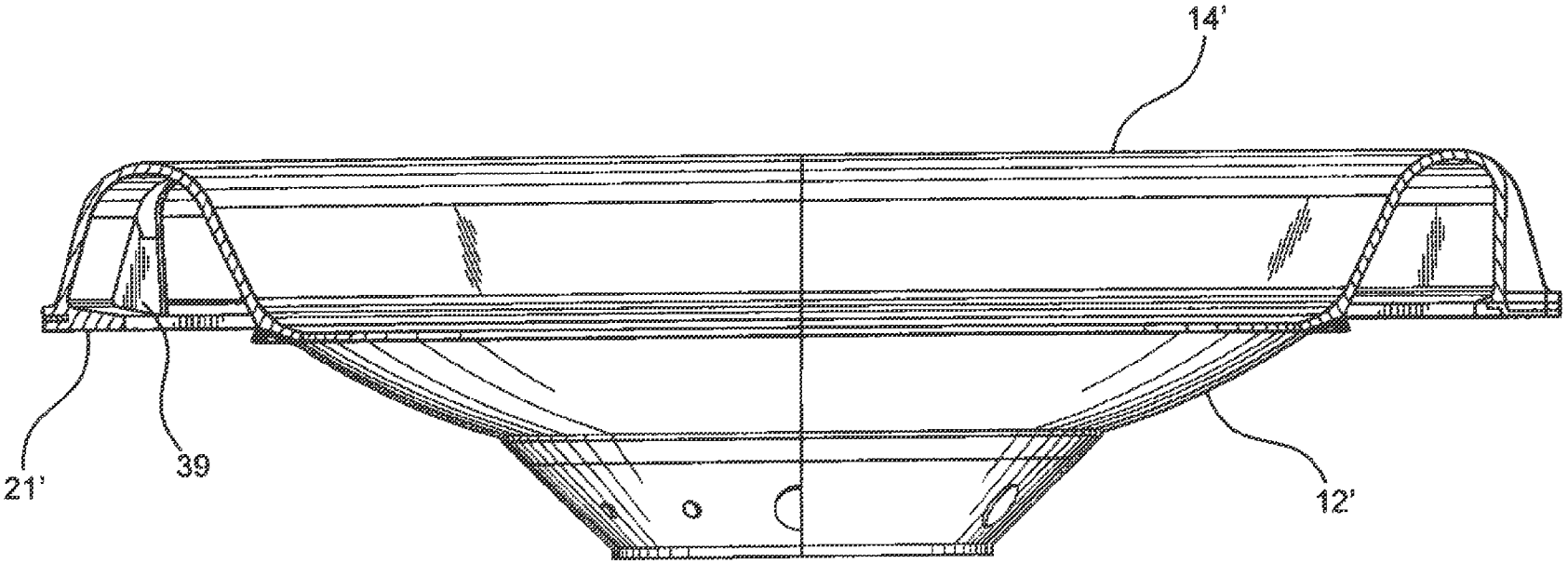
FIG. 10 is a cutaway view of the embodiment of FIG. 7 along line A-B-C thereof.
Figure 11:
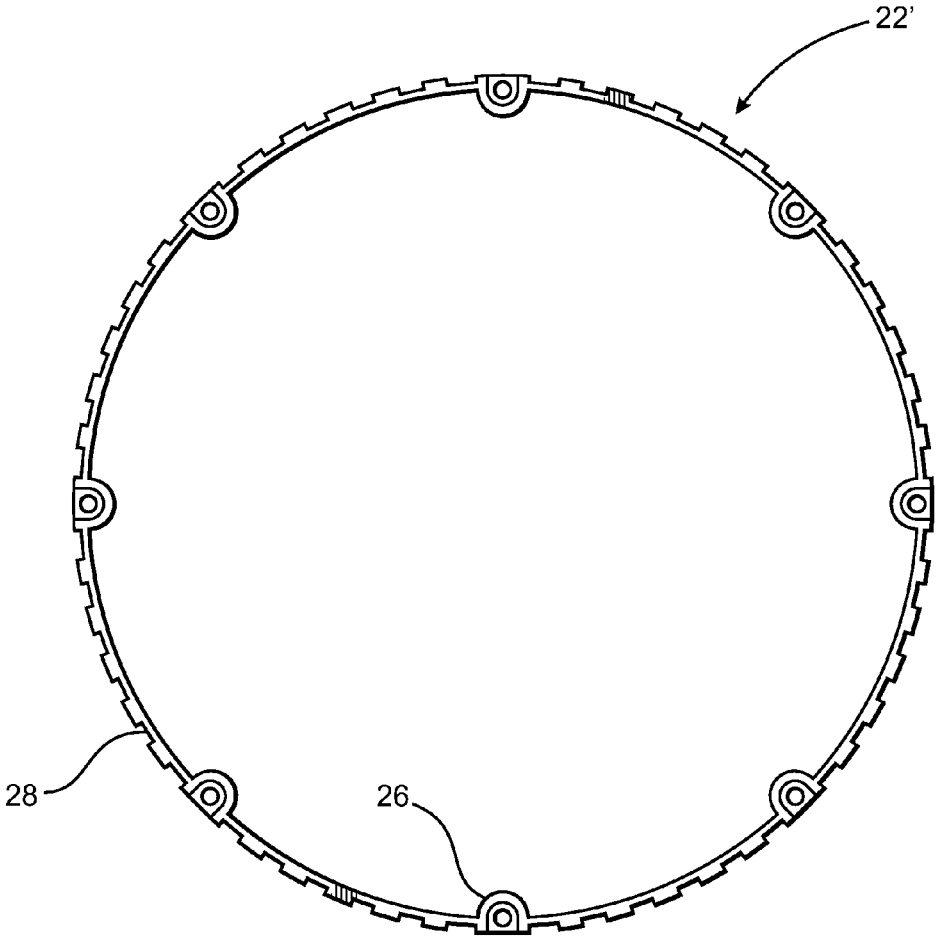
FIG. 11 is a top view of the reinforcement member of FIG. 7.
Figure 12:
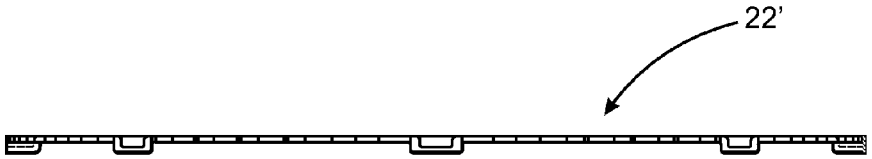
FIG. 12 is an elevation view of the reinforcement member of FIG. 7.

The outer portion 20 of the surround 14 can also include one or more support members 39 disposed and structured to provide additional support to the surround 14, and particularly to the outer portion 20, itself. In a further embodiment, the outer portion 20 comprises a plurality of support members 39. Moreover, in at least one embodiment, at least one support member 39 is connected to the lip 21. In a still further embodiment, each of a plurality of support members 39 is connected to the lip 21. For example, FIGS. 8 and 10 illustrate one embodiment of a support member 39 having a fin-like configuration which is connected to the lip 21'. In this embodiment, each support member 39 is also connected to a substantial section of the interior of the outer portion 20'. Further, each support member 39 comprises an inner peripheral edge 40, as shown in FIG. 8. The inner peripheral edge 40 may be disposed in engaging relation to an interior surface of the outer portion 20' along at least a majority of a length of the inner peripheral edge 40. The inner peripheral edge 40 may be oriented in transverse relation relative to a circumferential length of the inner surface of the outer portion 20', as similarly shown in FIG. 8. It is understood, however, to be within the scope and intent of the present invention that other configurations may be utilized as well.

The surround 14 can be made from any suitable material that can sufficiently suspend the diaphragm 12 during operation of the speaker assembly 10. For instance, in one embodiment, the surround 14 comprises a foam rubber material of construction. Moreover, any of the components or portions of the surround 14, such as the outer portion 20, the lip 21, the support member 39, etc., may also comprise a foam rubber material of construction, although other suitable materials may be utilized for such portions as well.

Referring again to FIGS. 1 and 2, in at least one embodiment, the speaker assembly 10 also includes a reinforcement member 22 cooperatively structured with the surround 14 to provide additional strength to the assembly 10, such that the structural integrity of the surround 14 is reinforced during operation of the assembly 10. In a further embodiment, the reinforcement member 22 is additionally structured to attach to both the surround 14 and to the frame 18 so as to secure the surround 14 in a fixed position relative to the frame 18. More specifically, in such an embodiment, the reinforcement member 22 attaches to both the outer portion 20 of the surround 14 and to the flange 19. In a further embodiment, the reinforcement member 22 is disposed at least partially between the surround 14 and the frame 18, as depicted in the embodiment of FIGS. 1 and 2.

Figure 3:
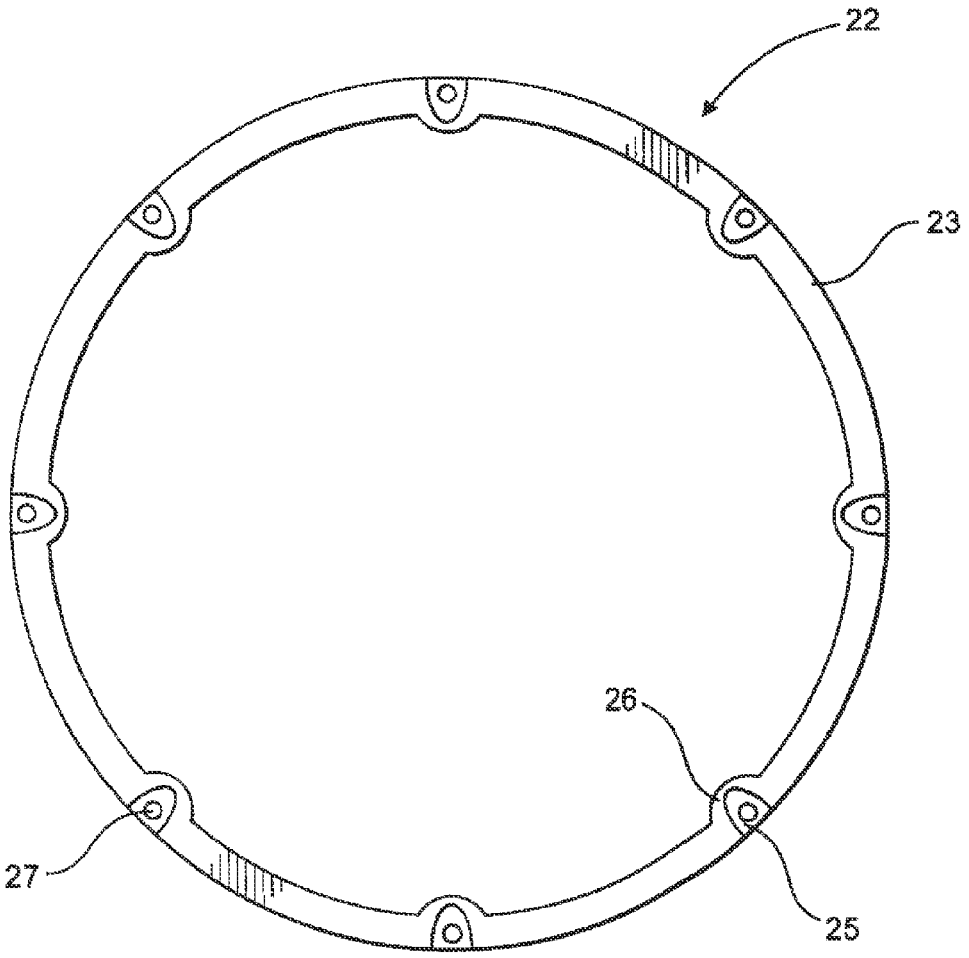
FIG. 3 is a top view of the reinforcement member of FIG. 1.
Figure 4:
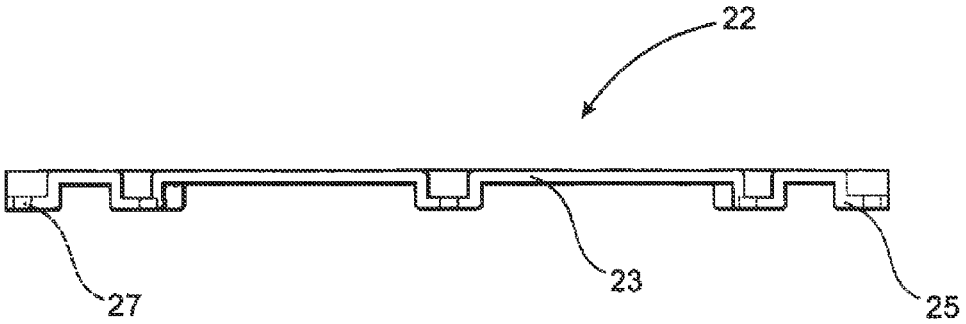
FIG. 4 is an elevation view of the reinforcement member of FIG. 1.

FIGS. 3 and 4 further illustrate the details of one embodiment of the reinforcement member 22. In particular, the reinforcement member 22 comprises a base 23 having a ringed, or annular, configuration. It is understood, however to be within the scope and intent of the present invention for other configurations to be utilized, including, but not limited to, a rectangular configuration, a segmented configuration, etc.

The reinforcement member 22 further comprises a plurality of offsets 25 which facilitate attachment to the frame 18. In at least one embodiment, the offsets 25 are outwardly extended from the base 23 of the reinforcement member 22, as seen in FIG. 4. The offsets 25 can be attached to the frame 18 using fasteners, adhesives, welds, etc. In a further embodiment, the offsets 25 each comprise an aperture 27 structured to receive a fastener 51 utilized to secure the reinforcement member 22 to the frame 18. The fasteners 51 may comprise any of a variety of structures and configurations including, but not limited to, screws, rivets, bolts, staples, nails, etc.

The reinforcement member 22 additionally comprises a plurality of protrusions 26. In one embodiment, each protrusion 26 corresponds to the location of a different one of the offsets 25. The protrusions 26 further facilitate attachment of the reinforcement, member 22 to the surround 14.

With respect to the embodiment of FIGS. 7-13, the reinforcement member 22' additionally comprises a plurality of recesses 28. The recesses 28 are shown in detail in FIG. 11. In at least one embodiment, the recesses provide the reinforcement member 22' with an amount of flexibility. The recesses 28 can also facilitate cooperative engagement of the reinforcement member 22' and the surround 14'. In addition, the recesses 28 can reduce the weight of the reinforcement member 22'.

The reinforcement member 22 can be made from any suitable material that can sufficiently reinforce the structural integrity of the surround 14, particularly during operation of the speaker assembly 10. For example, in one embodiment, the reinforcement member 22 comprises a steel material construction.

Figure 5:
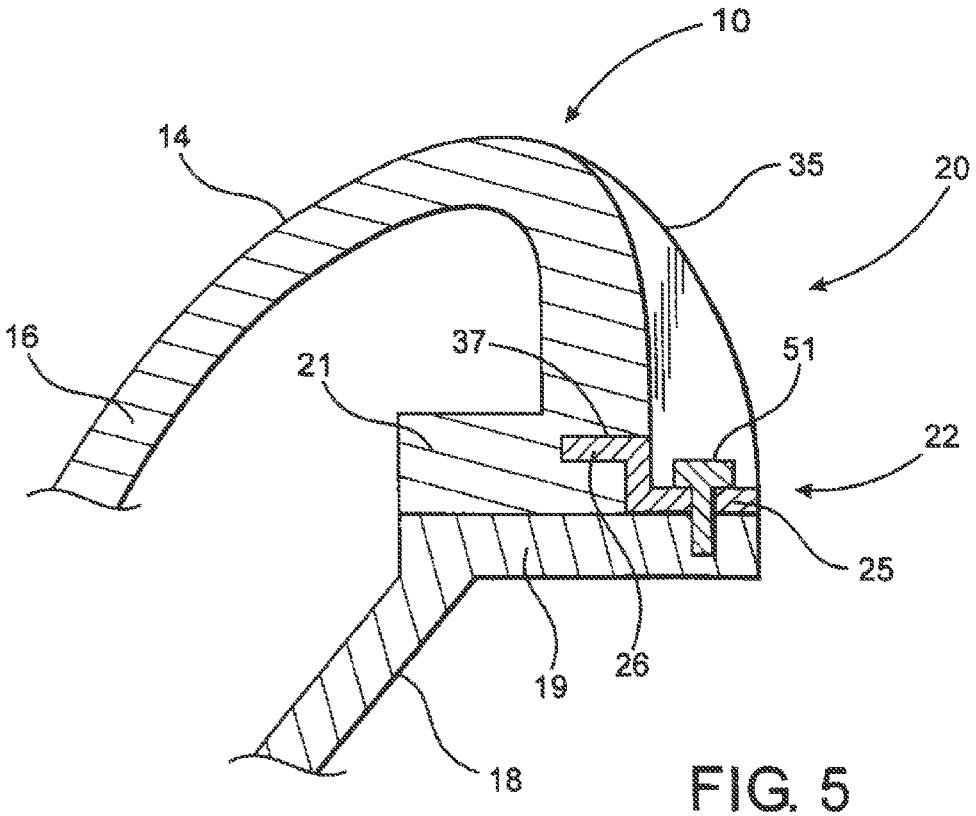
FIG. 5 is a partial cross-sectional view of the embodiment of FIG. 1 along line 5-5 thereof.
Figure 6:
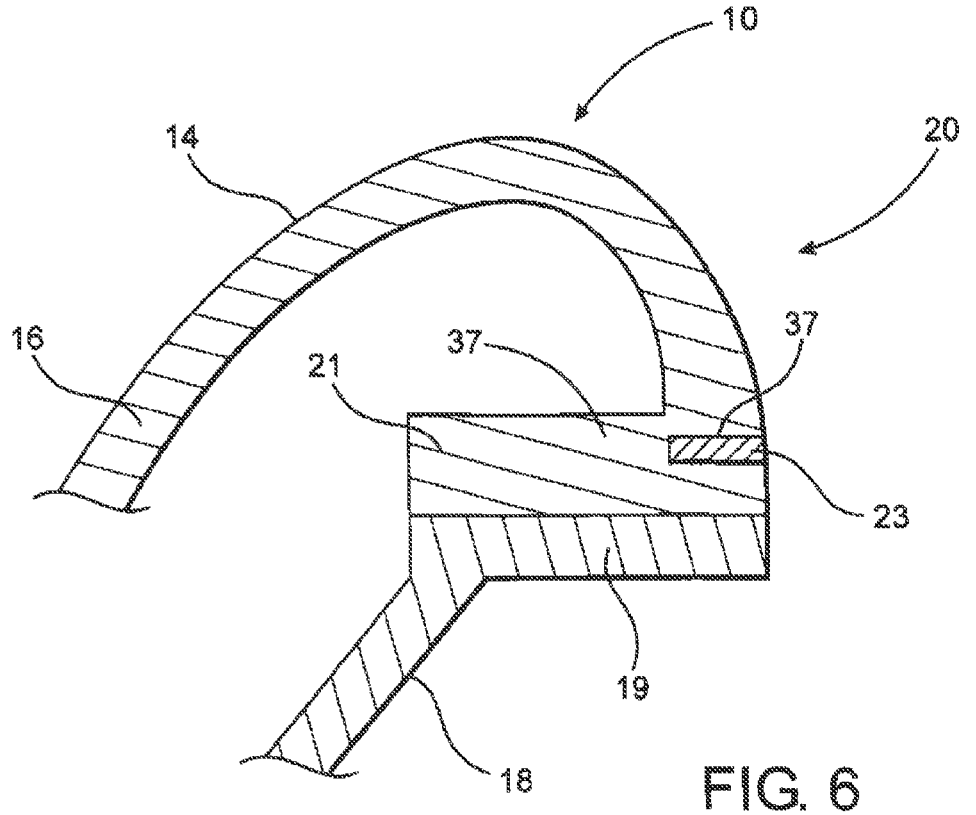
FIG. 6 is a partial cross-sectional view of the embodiment of FIG. 1 along line 6-6 thereof.

Turning in greater detail to the operative orientation of the reinforcement member 22 relative to the speaker assembly 10, FIGS. 5 and 6 depict partial cross-sectional views of the embodiment of FIG. 1, namely, at the offsets (FIG. 5) and between the offsets (FIG. 6), respectively.

As seen in the embodiment of FIG. 5, the reinforcement member 22 is generally disposed within a lower area of the outer portion 20 of the surround 14, and is attached to the outer portion 20 of the surround 14 as well as to the flange 19.

More specifically, the reinforcement member 22 is partially disposed within the outer portion 20 of the surround 14, and the offsets 25 are attached to the flange 19 utilizing fasteners 51. In this embodiment, each fastener 51 secures each offset 25 to the flange 19. Each offset 25 is also aligned with a corresponding one of a plurality of indentations 35 spaced about the periphery of the outer portion 20. Each indentation 35 facilitates the placement of each respective fastener 51 into its operative position. In a further embodiment, the outer portion 20 and/or the offsets 25 can also be glued to the flange 19.

FIG. 5 shows the protrusion 26 of the reinforcement member 22 disposed within the outer portion 20 of the surround 14. More specifically, the outer portion 20 comprises a slot 37 which extends along the periphery of the outer portion 20 and which is structured to receive each protrusion 26, as well as the base 23. In one embodiment, the slot 37 extends continuously along the periphery of the outer portion 20. In another embodiment, at least one slot 37 extends along a portion of the periphery of the outer portion 20. In a further embodiment, multiple slots 37 are used.

Likewise, FIG. 6 shows the base 23 of the reinforcement member 22 disposed within the slot 37. In this embodiment, the attachment of the outer portion 20 of the surround 14 and the reinforcement member 22 is maintained by the fitting together of the continuous slot 37 with the base 23 and the protrusions 26. In other embodiments, the reinforcement member 22 and the outer portion 20 of the surround 14 can be also be glued, bonded, fastened, or otherwise attached.

Figure 7:
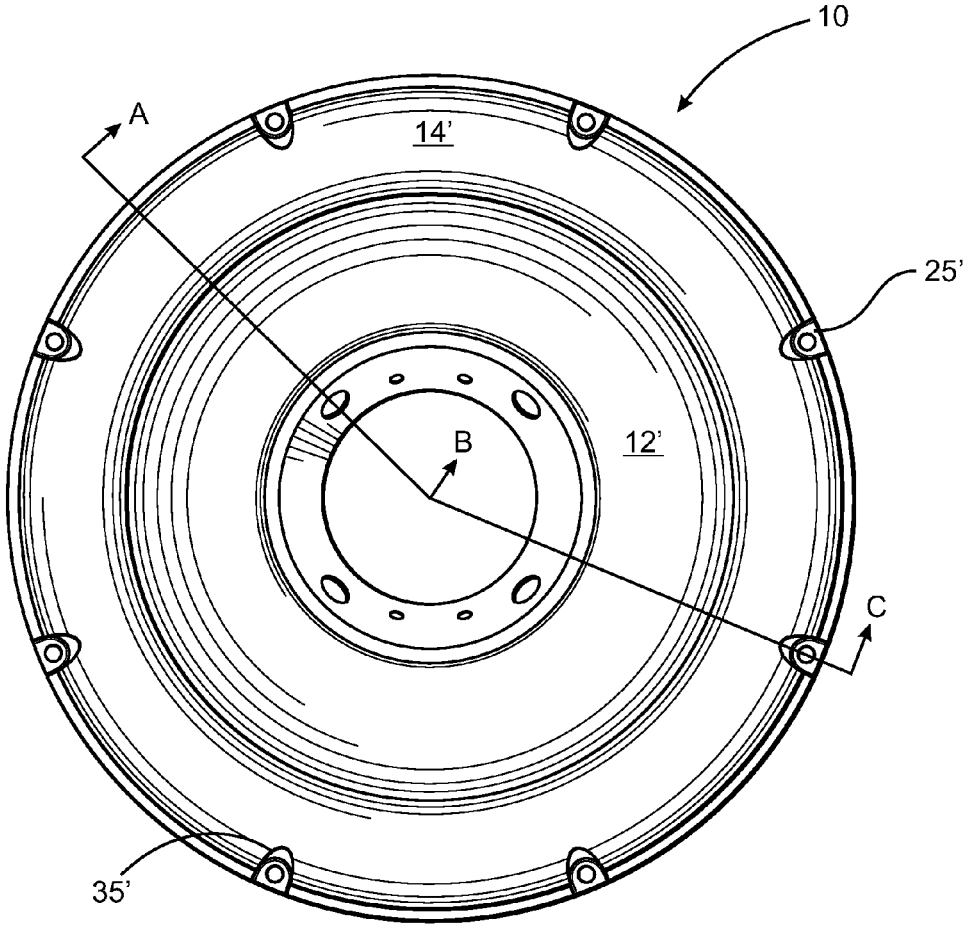
FIG. 7 is a top view of another embodiment of the present invention.
Figure 9:
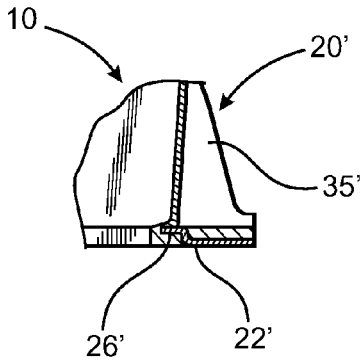
FIG. 9 is a partial cutaway view of the embodiment of FIG. 7 along a portion of line B-C thereof.
Figure 13:
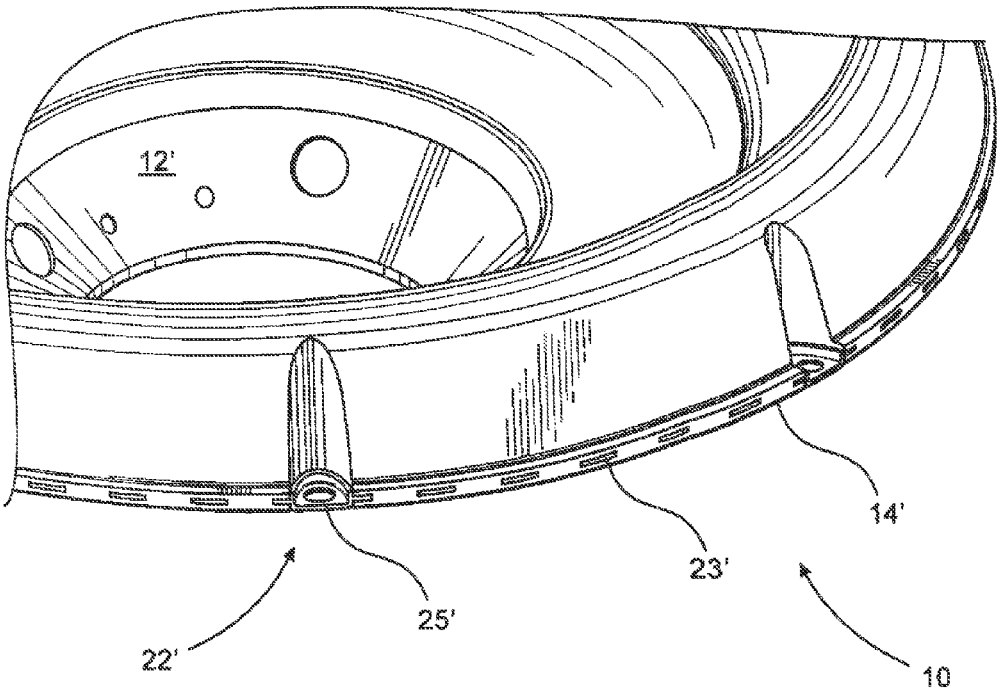
FIG. 13 is a perspective view of the embodiment of FIG. 7.

FIGS. 8-10 and 13 illustrate similar details for the operative orientation of the reinforcement member 22' of FIG. 7. For example, FIG. 8 shows the base 23' of the reinforcement member 22' disposed within the outer portion 20'. Likewise, FIG. 9 depicts the protrusion 26' of the reinforcement member 22' disposed within the outer portion 20'. FIG. 13 particularly highlights the cooperative orientation of the reinforcement member 22' and the surround 14' in three dimensions.

Figure 14:
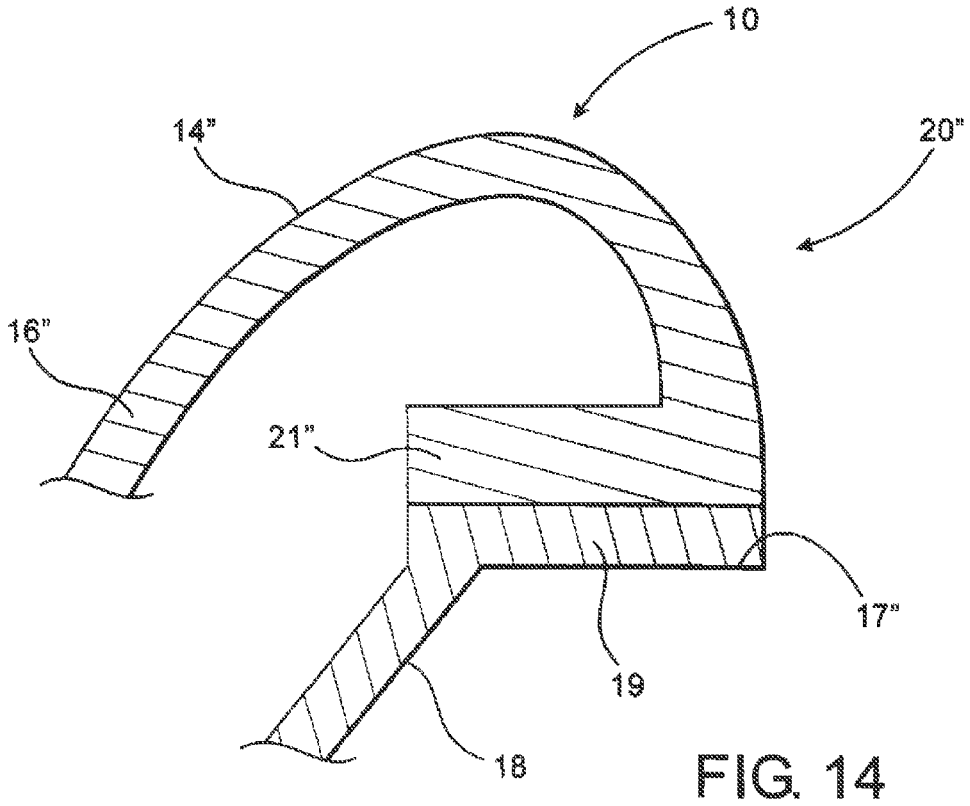
FIG. 14 is a partial cross-sectional view of another embodiment of the present invention.

Turning now to FIG. 14, it should be noted that, although some embodiments of the present invention include at least one reinforcement member 22, it is also contemplated that other embodiments of the present invention do not include any reinforcement members 22. As such, the embodiment of FIG. 14 depicts the outer portion 20" of the surround 14" disposed, dimensioned, and configured to permit the mounting of the surround 14" to the frame 18. Thus, the outer portion 20" of the surround 14" is generally disposed on the flange 19, with the mounting surface 17" of the outer portion 20" of the surround 14" extending inward relative to the outer periphery of the surround 14". In addition, the outer portion 20" of the surround 14" further comprises a lip 21" which extends inward relative to the outer periphery of the surround 14", with the mounting surface 17" extending along the lip 21".

Figure 15:
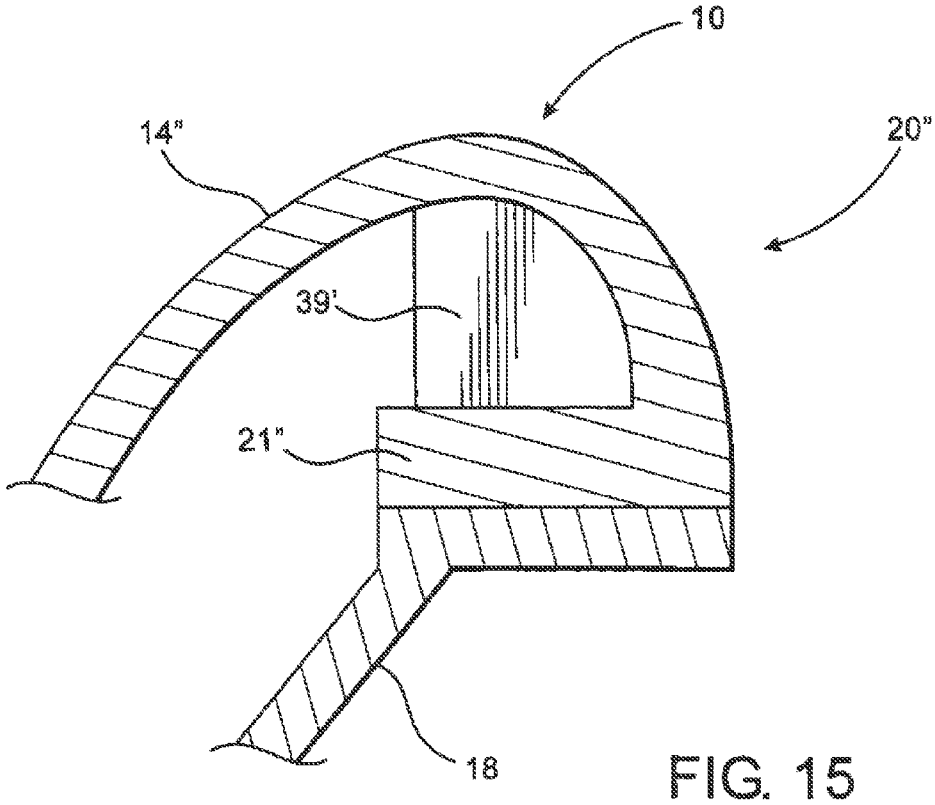
FIG. 15 is a partial cross-sectional view of yet another embodiment of the present invention.

As depicted in FIG. 15, the embodiment of FIG. 14 can also be modified to include one or more support members 39' disposed and structured to provide additional support to the surround 14". In this embodiment, each support member 39' possesses a fin-like configuration which is connected to the lip 21". Moreover, each support member 39' is also connected to a substantial section of the interior of the outer portion 20". It is understood, however, to be within the scope and intent of the present invention that other configurations may be utilized as well.

It should also be noted that, although the embodiments of the speaker assembly 10 shown in the accompanying figures are generally radially symmetric, it is intended to be within the intent and scope of the present invention that other configurations can be utilized including, but not limited to, rectangular configurations.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A speaker assembly comprising:

a frame including a flange disposed about an outer periphery thereof;

a surround comprising an outer portion and an inwardly projecting lip at an outer periphery of said outer portion;

said lip comprising a mounting surface secured to said flange; said lip, said flange and said mounting surface disposed and oriented inwardly of exterior peripheries of said outer portion and said frame, a plurality of support members disposed in spaced relation to one another on an interior of said outer portion, each of said plurality of support members being generally rigid and structured to provide additional support to said outer portion, each of said plurality of support members connected to said lip and extending transversely outward therefrom into engaging and supporting relation to an interior surface of said outer portion, each of said plurality of support members includes an at least partially curved inner peripheral edge disposed in engaging relation to said interior surface of said outer portion along at least a majority of a length of said curved inner peripheral edge, and said curved inner peripheral edge of each of said plurality of support members corresponding in shape to a corresponding, engaged portion of said interior surface of said surround.

2. A speaker assembly as recited in claim 1 wherein each of said plurality of support members comprises a fin configuration disposed in a transverse orientation relative to a circumferential length of said outer portion.

3. A speaker assembly comprising:

a frame including a flange attached to an outer periphery thereof;

a diaphragm;

a surround comprising an inner portion attached to said diaphragm and an outer portion attached to said frame;

said outer portion of said surround disposed, dimensioned, and configured to mount said surround to said frame absent an outwardly extending peripheral connecting portion on said surround;

said outer portion further comprising a lip which extends inward relative to an outer periphery of said surround and structured to be secured to said flange, interior of outer peripheries of said frame and said outer portion; and a plurality of support members disposed in spaced relation to one another within an interior of said outer portion, each of said plurality of support members being generally rigid and structured to provide additional support to said outer portion;

each of said plurality of support members including an at least partially curved inner peripheral edge disposed in engaging relation to said lip and to an inner surface of said outer portion, at least a majority of a length of said curved inner peripheral edge of each of said plurality of support members extending along said inner surface of said surround in transverse relation to a circumferential length of said lip and said inner surface, and said curved inner peripheral edge of each of said plurality of support members corresponding in shape to a corresponding, engaged portion of said interior surface of said surround.

4. A speaker assembly as recited in claim 3 wherein each of said plurality of support members comprises a fin configuration disposed in transverse orientation relative to a circumferential length of said outer portion.

5. A speaker assembly as recited in claim 3 wherein each of said plurality of support members extends transversely outward from said lip into engaging and supporting relation to said interior surface of said outer portion.

6. A speaker assembly as recited in claim 1 wherein said curved inner peripheral edge of each of said plurality of support members is disposed in transverse relation to a circumferential length of said inner surface.

* * * * *